US011759855B2

(12) United States Patent
Mohanty et al.

(10) Patent No.: US 11,759,855 B2
(45) Date of Patent: Sep. 19, 2023

(54) METHOD AND APPARATUS FOR BATCH PRODUCTION OF, AND CONTINUOUS APPLICATION OF, A REFRACTORY COMPOSITION TO A SURFACE

(71) Applicant: VESUVIUS U S A CORPORATION, Champaign, IL (US)

(72) Inventors: Bedadibhas Mohanty, Cranberry Township, PA (US); David R. Self, Massillon, OH (US)

(73) Assignee: VESUVIUS USA CORPORATION, Champaign, IL (US)

( * ) Notice: Subject to any disclaimer, the term of this patent is extended or adjusted under 35 U.S.C. 154(b) by 0 days.

(21) Appl. No.: 17/777,329

(22) PCT Filed: Dec. 4, 2020

(86) PCT No.: PCT/EP2020/084735
§ 371 (c)(1),
(2) Date: May 17, 2022

(87) PCT Pub. No.: WO2021/110967
PCT Pub. Date: Jun. 10, 2021

(65) Prior Publication Data

US 2022/0410257 A1 Dec. 29, 2022

(30) Foreign Application Priority Data

Dec. 6, 2019 (EP) ..... 19214069

(51) Int. Cl.
*B22D 41/02* (2006.01)
*B05B 7/14* (2006.01)
(Continued)

(52) U.S. Cl.
CPC ..... *B22D 41/023* (2013.01); *B05B 7/1436* (2013.01); *B05B 7/1481* (2013.01);
(Continued)

(58) Field of Classification Search
CPC .... B22D 41/023; B22D 41/02; B05B 7/1436; B05B 7/1481; B05B 7/0416; B05B 7/12;
(Continued)

(56) References Cited

U.S. PATENT DOCUMENTS 4,298,288 A * 11/1981 Weisbrod ..... B28C 9/0454 366/11
5,141,363 A * 8/1992 Stephens ..... C04B 28/02 405/150.2
(Continued)

FOREIGN PATENT DOCUMENTS

AU 418931 B2 11/1971
CN 109530667 A 3/2019
(Continued)

*Primary Examiner* — Charles Cooley
(74) *Attorney, Agent, or Firm* — MaxGoLaw PLLC

(57) ABSTRACT

A device and a process for the continuous application of a refractory slurry to a surface incorporate a batch reactor (10) for the controlled mixing of the slurry, a product vessel (60) in communication with the batch reactor (10) to contain the mixed slurry, and a variable-rate spraying applicator or nozzle in communication with the product vessel and with an air supply. A controller (100) controls input to, output from, and the operation of, the batch mixer (10), and monitors batch production. The controller (100) monitors the amount of slurry contained in the product vessel (60). If the level of slurry in the product hopper is such that the product hopper cannot accommodate an additional batch of slurry, the controller interrupts batch production and resumes production when the product hopper can accept the contents of the batch reactor (10).

13 Claims, 2 Drawing Sheets

(51) Int. Cl.

| | |
|---|---|
| ***B28C 5/02*** | (2006.01) |
| ***B28C 7/02*** | (2006.01) |
| ***B28C 7/04*** | (2006.01) |
| ***B28C 7/16*** | (2006.01) |

(52) U.S. Cl.
CPC ..... *B28C 5/026* (2013.01); *B28C 7/026* (2013.01); *B28C 7/0418* (2013.01); *B28C 7/165* (2013.01)

(58) Field of Classification Search
CPC ..... B28C 5/026; B28C 7/026; B28C 7/0418; B28C 7/165; B28C 7/02; B28C 7/163; C21C 5/443; B01J 4/001; B01J 4/008; B01J 19/0006; B01J 19/18; F27D 1/16
USPC ..... 366/11
See application file for complete search history.

(56) References Cited

U.S. PATENT DOCUMENTS

| | | | | |
|---|---|---|---|---|
| 5,795,060 | A * | 8/1998 | Stephens | B01F 35/883 366/8 |
| 5,803,596 | A * | 9/1998 | Stephens | A62C 5/02 261/DIG. 26 |
| 5,803,665 | A * | 9/1998 | Stephens | C04B 40/0028 405/184.5 |
| 2022/0410257 | A1 * | 12/2022 | Mohanty | B28C 7/026 |

FOREIGN PATENT DOCUMENTS

| | | | |
|---|---|---|---|
| DE | 4217373 | A1 | 12/1993 |
| EP | 0286513 | A1 | 10/1988 |
| WO | 9711802 | A1 | 4/1997 |
| WO | WO-9840168 | A1 * | 9/1998 |

* cited by examiner

METHOD AND APPARATUS FOR BATCH PRODUCTION OF, AND CONTINUOUS APPLICATION OF, A REFRACTORY COMPOSITION TO A SURFACE

RELATED APPLICATIONS

This application is the National Stage application of International Application No. PCT/EP2020/084735, filed Dec. 4, 2020, which claims the benefit of European Provisional Patent Application No. EP 19214069.7, filed Dec. 6, 2019, the contents of each of which are incorporated by reference into this specification.

BACKGROUND

The information described in this background section is not necessarily admitted prior art.

Tundishes and ladles are intermediate containment vessels used in processing metals and metal alloys. These vessels contain a permanent refractory lining material, which is resistant to high temperatures. Typically, these permanent linings are formed from bricks or castables, and comprise 50 to 70% Al203. Although these permanent lining materials are highly resistant to elevated temperatures, contact with molten metal and slag, and numerous heating and cooling cycles during the processing of molten metals can degrade the permanent liner, so that frequent replacement of the permanent liner is required. Therefore, disposable liners, formed of dry vibratable, trowellable, gunnable, or sprayable refractory materials are formed upon the permanent liner of a tundish or other molten metal processing vessel to extend the useful life of the permanent liner.

In the spraying process for application of a refractory formulation to a permanent liner, refractory powder is mixed with water, and with such additives as binders, wetting agents and dispersants, to produce a slurry. The slurry is conveyed under pressure to a spray nozzle, where compressed air is introduced to propel the slurry from the nozzle. The spraying process accommodates homogeneous mixing, because mixing occurs before the components reach the nozzle, and the mixing time is not limited to the contact time of two components within a spray nozzle.

The mixing of water and refractory powder may be accomplished in a batch process, in which predetermined quantities of the water and refractory powder are enclosed in a container and are subjected to procedures such as stirring. Batch processes offer the ease of controlling processing conditions, such as the intensity of stirring, the energy introduced into the sample by stirring, and the amount of air entrained into the sample. The mixing of water and refractory powder may also be accomplished at a continuous process, in which water and refractory powder are introduced into a container inlet and are combined and processed as they pass through the container to a container outlet. However, controlling process conditions is difficult in a continuous process. The spraying process is, for the most part, a continuous process, though the rate of application of the slurry may vary and may be interrupted for various reasons. The need for slurry in the application process is not constant. Nonetheless, the spraying process is dependent on a constant supply of slurry.

It has been found that properties, such as density and porosity, of certain sprayed refractory formulations are dependent on factors such as the presence of additives such as foaming agents in the slurry in combination with the intensity of stirring of the slurry, and the length of time over which stirring of the slurry occurs.

These factors are more easily controlled in a batch process than in a continuous process, but the need to produce consecutive batches of slurry to feed the spray nozzle requires that the rate of slurry consumption and the amount of slurry available must be monitored so that the mixing of slurry can be controlled if batch mixing is used.

WOI 9971 1802 to Daussan discloses a method and device for producing and spraying an aqueous slurry. The aqueous slurry is mechanically stirred to foam and/or swell the surfactant and the stirring power and/or speed and/or time are adjusted in order to control the foaming and/or swelling rate of the surfactant and thus vary the porosity of the sprayed coating. However, there is no disclosure of a method or apparatus in which the start of a batch process feeding a continuous application process is controlled by data produced by a sensor on a storage vessel directly feeding an applicator so that a constant supply of slurry may be produced.

IJS4298288 to Weisbrod discloses a mobile concreting method and apparatus in which a plurality of ingredients are fed in a controlled manner into a mixing device to produce a slurry. The slurry is transferred from the mixing device to a nozzle and thence to a surface to be coated. However, the Weisbrod method is not a batch processing method; the Weisbrod device is not configured for batch processing. Consequently, there is no disclosure of a method or apparatus in which the start of a batch process feeding a continuous application process is controlled by data produced by a sensor on a storage vessel directly feeding an applicator so that a constant supply of slurry may be produced.

EP0286513A1 ((DAUSSAN & CO [FRI) 12 Oct. 1988 (1988-101 2)) is directed to a method and a device for applying an insulating refractory coating comprising at least two layers of equal or unequal thickness, of different compositions and equal or different water contents, onto a surfaces such as the interior of a metallurgical vessel. The device incorporates a powder bin, a valve permitting or impeding flow from the powder bin, a mixing member receiving material from the powder bin as well as water, a product vessel receiving material from the mixing member, a sensor sensing the content or level of the mixed material in the sensor, a controller for regulating at least the amount of water in the mixture, and a nozzle for applying the mixture. This device can produce formulations with preselected densities by varying the amounts of components admitted to a batch process, but is unable to control the mix energy introduced into a batch process over a defined period of time to produce formulations with preselected densities.

DE4217373A1 ((KLAUS OBERMANN GMBH [DE]) 16 Dec. 1993 (1993 Dec. 16)) discloses an apparatus for preparing mixtures or suspensions containing one liquid component (e.g., water-cement mixtures, water-bentonite suspensions and the like), has a mixer which is supplied with dosed amounts of liquid and solid (powder, granulate, paste or slurry) components from separate supply sources and which is followed by a pump for transporting the final mixture in a pipeline leading to a supply container or a consumer. The mixer is a continuous mixer which is supplied continuously with the liquid and solid components in amounts corresponding to the final mixture discharged via the pump. The apparatus is not configured to incorporate a batch process wherein, for example, a controlled amount of mix energy may be introduced into a batch over a defined period of time.

Accordingly, the development of a device and process that provide the advantages of both batch and continuous processes in the combination of components of a refractory formulation for sprayable application would be advantageous, and would enable continuous production of a product in which various density values can be achieved with a single formulation.

SUMMARY

The invention described in this specification is directed to devices and processes for the batch production of refractory slurries and for their uninterrupted spray application.

An exemplary device of the invention contains a batch reactor configured to mix components of a formulation to produce a refractory slurry. The batch reactor is in communication with a plurality of charging inlets. Flow or passage through each reactor charging inlet is regulated by an actuator which controls, for example, a pump, a feeder or a valve installed in the respective inlet. The charging inlets provide communication between respective feed lines or storage vessels, through respective actuators, to the batch reactor. The batch reactor is furnished with a reactor outlet that, when positioned and opened, feeds the contents of the reactor vessel into a product vessel. The product vessel is furnished with a product vessel outlet through which the contents of the product vessel may pass.

The product vessel outlet is in fluid communication with an applicator pump, which is in fluid communication with an applicator by way of an applicator product inlet. An air supply inlet, through which flow is regulated by an air supply valve, is also in communication with the applicator. Within the applicator, the air supply inlet and the product inlet merge to form an outlet, which passes through an applicator nozzle.

A controller accepts information input from a human interface and from sensors. A product quantity sensor provides measurements of the product quantity in the product vessel to the controller. Flow rate sensors provide measurements of the flow rate through the air supply inlet and the product inlet. The controller controls actuators regulating flow or passage through reactor charging inlets. The controller controls actuators regulating the start, stop and speed or intensity of processes, such as mixing, within the batch reactor. The controller controls an actuator affixed to the outlet of the batch reactor that regulates the opening and closing of the batch reactor outlet. The controller controls an application pump actuator, in communication with the applicator pump, which starts, stops, or regulates the rate of transfer of product through the actuator pump. An air supply inlet actuator starts, stops, or regulates the flow of air through the air supply inlet.

The process of applying a refractory formulation according to the invention is carried out in the following manner: Charging inlets are disposed to accept formulation components into a batch reactor. Information is input into the controller, the information including batch formulation, batch mixing time and speed. The controller controls actuators to admit the formulation components into the batch reactor. The controller controls actuators to start batch production, to regulate batch production, and to stop batch production when the process is completed. At the completion of batch production, the controller accepts input from the product vessel quantity sensor, and determines whether the contents of the batch reactor can be accommodated in the product vessel. If the contents of the batch reactor can be accommodated in the product vessel, the controller signals an actuator to open the outlet of the batch reactor, and the processed batch is transferred to the product vessel, and can be conveyed by a slurry pump to the nozzle. Spraying can now begin, and processing of a new batch can commence.

A continuous supply of batch-produced formulation can be maintained as follows:

The controller maintains or collects information on the on/off status of the slurry pump, the presence or absence of a batch in the batch reactor, the size of a batch in the batch reactor, the on/off status of the batch reactor drive, the remaining mixing time for a batch in the batch reactor, the amount of slurry in the product vessel, and whether the batch production and continuous application device is being initialized (i.e., the product vessel is being partially or completely filled with slurry before spraying commences).

If the device is not being initialized and if the slurry pump is not pumping, no new batches are started.

If the slurry pump is pumping, the amount of slurry in the product vessel is monitored on a regular basis, and the accommodation amount of the product vessel is derived. The accommodation amount of the product vessel is the amount of slurry that can be accepted from the batch reactor; it is the result of subtraction of the amount of slurry in the product vessel from the amount of slurry that can be accepted from the batch reactor when the product vessel is empty. The accommodation amount of the product vessel is compared with the amount of slurry in the batch reactor. The controller performs actions on the comparison of accommodation amount (AA) in the product vessel with the amount of slurry in the batch reactor (BR), the presence/absence of a batch (Y/N) in the batch reactor, the on/off status of the batch reactor drive (BRD), and the remaining mixing time (RMT) for a batch in the batch reactor.

For AA>BR, BR: N, and BRD OFF, formulation components are admitted to the batch reactor, and BRD is turned ON to initiate batch processing. The situation in which AA>BR, BR: N, and BRD: ON does not occur in normal operation.

For AA>BR, BR: Y, BRD OFF, and RMT>0, BRD is turned ON to complete batch processing. At the completion of batch processing, BRD is turned OFF and the processed batch is discharged from the batch reactor.

For AA>BR, BR: Y, BRD ON, and RMT>0, BRD remains ON until the batch processing is completed, at which time BRD is turned OFF and the processed batch is discharged from the batch reactor.

For AA>BR, BR: Y, BRD ON, and RMT=0, BRD is turned OFF and the processed batch is discharged from the batch reactor.

For AA>BR, BR: Y, BRD OFF, and RMT—–0, the processed batch is discharged from the batch reactor.

For AA<BR, BR: N, and BRD OFF, no action is taken until AA>BPI. The situation in which AA<BR, BR: N and BRD ON does not occur in normal operation.

until AA>BR.

until AA>BPI.

For AA<BR, BR: Y, BRD ON, and RMT>0, BRD is turned OFF

For AA<BR, BR: Y, BRD OFF, and RMT>0, BRD remains OFF

For AA<BR, BR: Y, BRD ON and RMT=0, BRD is turned OFF and the processed batch is retained in the batch reactor.

For AA<BR, BR: Y, BRD OFF and RMT=0, BRD remains off and the processed batch is retained in the batch reactor.

BRIEF DESCRIPTION OF THE DRAWINGS

Various features and characteristics of the invention described in this specification may be more thoroughly understood by reference to the accompanying figures, in which.

The reader will appreciate the foregoing features and characteristics, as well as others, upon considering the following detailed description of the invention.

DESCRIPTION

The refractory compositions described in this specification produce working linings or other refractory structures that provide anti-oxidation barrier properties during use in metallurgical vessels. As used in this specification, including the claims, the term "working lining" means an innermost refractory layer that contacts molten metal contained in a metallurgical vessel. As used in this specification, including the claims, the term "metal" means both metals and metallic alloys. As used in this specification, the expression "in receiving communication with" is used to describe a device or element of a device that accepts data, such as data in electronic form, being emitted from another device or element of a device. As used in this specification, the expression "in sensing communication with" is used to describe a device or element of a device that measures, analyzes, or otherwise derives information from another device, element of a device, content of a device, or a material sample. As used in this specification, the expression "in controlling communication with" is used to describe a device or element of a device that transmits commands to another device or element of a device. As used in this specification, the expression "in communication with" is used to express contact that may be either indirect, by way of an intermediate element, or direct, in which an intermediate element is not present.

Figure 1:
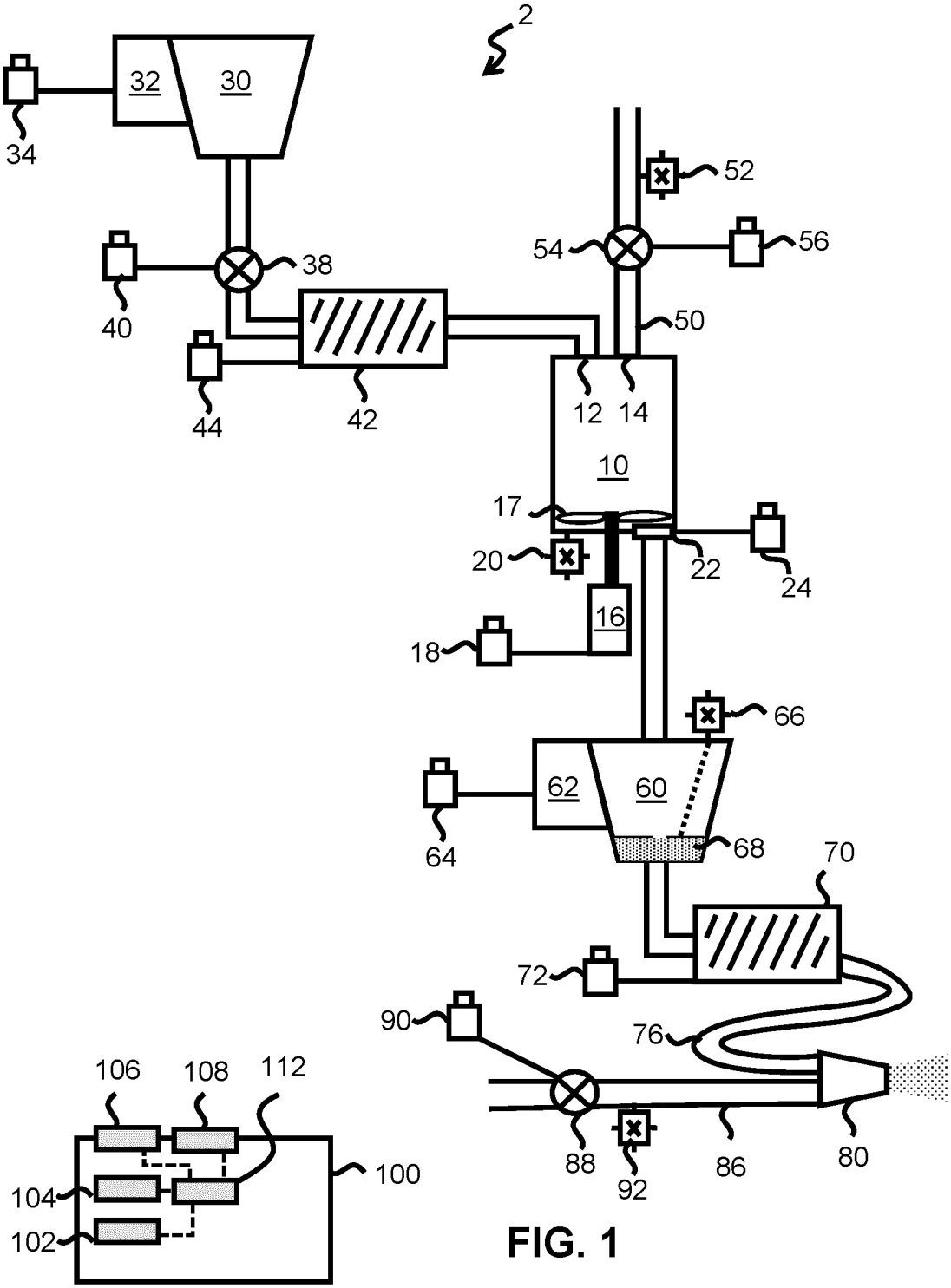
FIG. 1 is a schematic representation of a refractory slurry production and application device.

FIG. 1 is a schematic depiction of configuration of a batch production and continuous application device 2 containing a batch reactor 10. The batch reactor 10 is furnished with a powder feed port 12 and a water feed inlet 14. Batch reactor 10 is equipped with a batch reactor drive 16, which is attached to, in mechanical communication with, and able to impart motion to the mixing assembly 17, which may comprise blending, combining, agitating or stirring elements such as paddles and blades, within the batch reactor 10. A batch reactor drive 16 is regulated by a batch reactor drive regulator 18; Batch reactor drive regulator 18 is in controlling communication with the batch reactor drive 16. Batch reactor drive regulator 18 may start, stop, or vary the speed of, mixing assembly 17 within the batch reactor 10. A measurement sensor 20 provides weight measurements of the contents of the batch reactor 10. The load measurement sensor 20 is in sensing communication with the batch reactor 10.

The contents of the batch reactor are removed through a batch reactor door 22, which is regulated by a batch reactor door actuator 24; the batch reactor door actuator 24 opens and shuts the batch reactor door 22. The batch reactor door 22 constitutes an outlet of the batch reactor 10. The batch reactor door actuator 24 is in controlling communication with the door 22. A 5 port 2-way directional valve in communication with the batch reactor door actuator 24 may be used to operate the batch reactor door 22.

A powder bin 30 is equipped with a powder bin vibratory device 32 regulated by a powder bin vibratory actuator 34. The powder bin vibratory device 32 may be attached to the powder bin 30, or may be in communication with the powder bin 30.—The powder bin vibratory device actuator 34 is in controlling communication with the powder bin vibratory device 32. Powder is fed from the powder bin 30, through the powder feed valve 38 regulated by a powder feed valve regulator 40, to the inlet of a powder feeder 42 having an inlet and an outlet, containing a motor, and containing a material transfer device such as a screw or auger. The powder feeder 42 is controlled by a powder feeder regulator 44. The powder feeder regulator 44 enables the transfer of the selected amount of powder to the batch reactor 10. Measurements from the load measurement sensor 20 are processed and provided to the powder feeder regulator 44 to charge the batch reactor 10 with a predetermined amount of powder. Powder exiting the powder feeder 42 is fed to the powder feed port 12 of the batch reactor 10. A 5 port 2-way directional valve may be used as a powder feed valve 38. The powder feed valve 38 and the powder feed valve regulator 40 may be integrated. The powder bin 30 has an outlet; the powder feed valve 38 may be located at or near the powder bin outlet; the powder feed valve regulator 40 is in controlling communication with the powder feed valve 38. The outlet of the powder bin 30 is in communication with the inlet of the batch reactor.

A water supply line 50 passes by or through a water flow sensor 52 and through a water valve 54 controlled by a water valve actuator 56 into the water feed inlet 14 of the batch reactor 10. The water valve actuator 56 enables the transfer of the selected amount of water into the batch reactor 10. The water valve actuator 56 is in controlling communication with the water valve 54. The water flow sensor 52 is in sensing communication with the water supply 50. The water flow sensor 52 may contain a water rotor and a Hall effect sensor.

After mixing, the contents of the batch reactor 10 are fed into a product vessel 60 through the batch reactor door 22. The product vessel 60 has an inlet and an outlet; the inlet of the product vessel 60 is configured to receive the contents of the batch reactor 10 through door 22. In the configuration shown; door 22 is located above the inlet to the product vessel 60, and contents of the batch reactor 10 passing through door 22 fall into the product vessel 60. Product vessel 60 is equipped with a product vessel vibratory device 62 regulated by a product vessel vibratory actuator 64. Product vessel vibratory device 62 may be attached to the product vessel 60, or may be in communication with the product vessel 60. The product vessel vibratory actuator 64 is in controlling communication with the product vessel vibratory device 62. Product vessel 60 is equipped with a product vessel measuring sensor 66 for the measurement of slurry quantity 68 within the product vessel 60. The product vessel content sensor 66 is in sensing communication with the content 68 of the product vessel 60. Product vessel 60 may be provided with a lower portion in the shape of a frustum with its minimum radius disposed adjacent to the product vessel 60 outlet.

The contents of the product vessel 60 are fed into the inlet of slurry pump 70. Slurry pump 70 has an inlet and an outlet. The inlet of the slurry pump 70 is in direct or indirect communication with the outlet of the product vessel 60. Slurry pump 70 contains a motor and a material transfer configuration such as a screw. Slurry pump 70 is regulated by a slurry pump regulator 72. The slurry pump regulator 72 is in controlling communication with the slurry pump 70.

The output of the slurry pump 70 is propelled through a slurry hose 76 to a nozzle 80. The outlet of the slurry pump 70 is in communication with the inlet of the nozzle 80.

Air passes through an air hose 86, through an air supply valve 88 regulated by air supply valve actuator 90 and past or through air flow sensor 92 to nozzle 80. Air flow sensor 92 may be an analog device or a digital device.

In nozzle 80, air is injected into the slurry stream just prior to the point of exit. The slurry is propelled from the exit point of nozzle 80. Nozzle 80 has an inlet and an outlet. The nozzle inlet receives the output of the outlet of the product vessel 60; the nozzle inlet receives the output of air hose 86. The nozzle inlet may be divided into separate chambers, including a chamber to receive the output of the outlet of the product vessel 60, and a chamber to receive output of air hose 86; in this configuration, the product vessel chamber and the air chamber meet within nozzle 80 to communicate with the nozzle outlet. The flow of air in air hose 86 is regulated by air supply valve 88 and controlled by an air supply valve actuator 90.

Control of batch production and continuous application device 2 is achieved by controller 100, comprising a controller human/machine interface (HMI) display 102, a control panel 104, a command transmission port 106, a data acquisition port 108 and a processor 112. The human/machine interface display 102 is a device that permits interaction between a human being and a machine; it may accept and implement control instructions of an operator, and may present information to an operator about the state of a process. Control panel 104 is a surface that may contain manual controls, such as switches, buttons, knobs, or keypads, for device operation, and may contain display components, such as gauges and video screens, for providing device status information.

Figure 2:
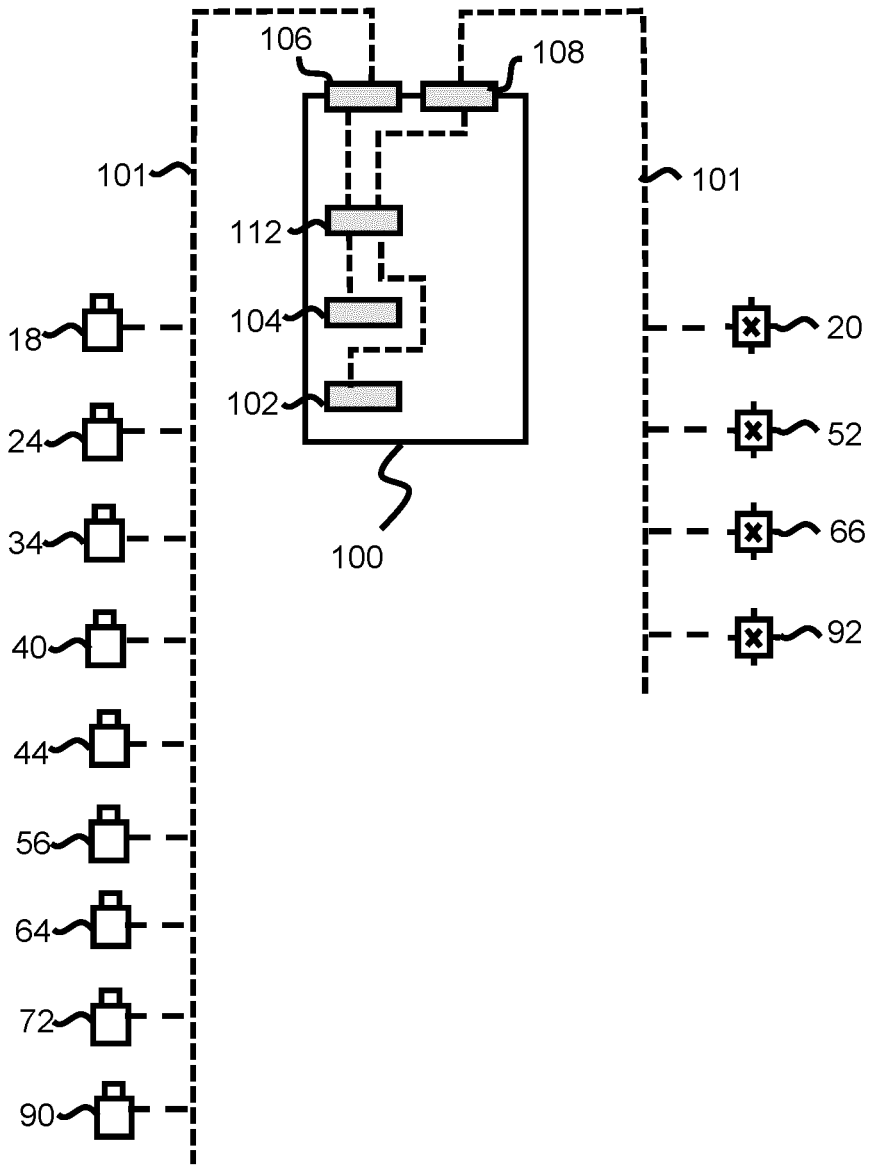
FIG. 2 is a schematic representation of the data acquisition and control elements of a refractory slurry production and application device.

FIG. 2 is a schematic depiction of the controller 100 and controller connections 101 of a device according to FIG. 1. The controller comprises a human/machine interface display 102 and a control panel 104, for viewing process data and entering commands, respectively. The human/machine interface display 102 and the control panel 104 may be separate devices or an integrated device.

Controller 100 contains a command transmission port 106. The controller is linked, through command transmission port 106, to the batch reactor drive regulator 18, the batch reactor door actuator 24, the powder bin vibratory actuator 34, the powder feed valve regulator 40, the powder feeder regulator 44, the water valve actuator 56, the product vessel vibratory actuator 64, the slurry pump regulator 72, and the air supply valve actuator 90.

Controller 100 contains a data acquisition port 108. The controller is linked, through the data acquisition port 108, to the load measurement sensor 20, the water flow sensor 52, the product vessel measuring sensor 66, and the air flow sensor 92.

Controller 100 contains a data processor/data storage unit 112 that accepts data input from, and is in receiving communication with, the human/machine interface display 102, the control panel 104, the load measurement sensor 20, the water flow sensor 52, the product vessel measuring sensor 66, and the air flow sensor 92. Data processor/data storage unit 112 performs calculations and logical operations on the data provided from the interface 102, the control panel 104, the sensors 20, 52, 66, and 92, and internally stored data. Commands based on the results of the calculations and logical operations are issued through command transmission port to regulators and actuators 18, 24, 34, 40, 44, 56, 64, 72 and 90. Data processor/data storage unit 112 is in controlling communication with regulators and actuators 18, 24, 34, 40, 44, 56, 64, 72 and 90.

The connections 101 between the controller and the various actuators and sensors may be made by wire, fiberoptic cable, or by wireless transmission. Devices may communicate by Ethernet/IP.

Specialized elements may be used in the device described herein.

Batch reactor 10 may take the form of a closed vessel equipped with an internal mixing assembly configured to mix the contents of the batch reactor 10. Batch reactor 10 may be equipped with a batch reactor drive 16 such as a 7500-watt gear motor connected to a variable frequency drive, and a mixing assembly 17 that may include mixing blades, such as batch reactor angular mud whip type mixing blades, connected to a rotating shaft driven by batch reactor drive 16. The batch reactor 10 may take the form of a drum style paddle mixer. A batch reactor 10 formed from a 0.25 cubic meter slurry containment drum will accommodate a 90 kg batch of refractory slurry. A pneumatic piston may be used as a batch reactor door actuator 24. The batch reactor door 22 is typically located in the bottom of the batch reactor 10. The product vessel 60 may be located below the batch reactor door 22 so that a completed batch can be dumped from the batch reactor 10 into the product vessel 60. In the presence of powder and water the mixer blades rotate at a defined speed and time controlled by the process as directed by the operator setpoints. By introducing low or high shear and intensified mix energy into the batch process over a defined period of time, the slurry physical properties can be altered to a desired result. The power of the motor may be 7500 watts or greater; it has been found that motor power of 7500 watts or greater is required to decrease the density of the refractory batch. Batch reactor drive 16 may be configured to supply at least 7500 watts of mechanical power to the mixing assembly 17.

Load measurement sensor 20 may be a load cell system such as a hydraulic load cell, a pneumatic load cell or a strain gauge load cell. A system with a 9000 kg capacity may be used.

A powder bin vibratory device 32, regulated by a powder bin vibratory actuator 34, may be used with the powder bin 30 to eliminate bridging, stuck material and uneven flow. The powder bin vibratory device 32 may be electrically or pneumatically powered. Typically, the powder bin vibratory device 32 is in physical contact with, or in communication with the powder bin 30. An 1800 kg storage bin may be suitable for use as the powder bin 30 in batch production and continuous application device 2.

Powder feeder 42 may contain a motor, such as a 750-watt electric gear motor connected to a variable frequency drive. Feeding of the powder may be accomplished by a conveyor such as a 10 cm auger-type screw.

Water valve actuator 56 for the water valve 54 may be a 2-way fluid solenoid.

Slurry level measuring sensor 66 may be a laser distance sensor. It may be disposed within, or above, product vessel 60. It may be oriented towards the exit port of the product vessel 60.

Slurry pump 70 may contain a motor, such as a 9300-watt electric gear motor connected to a variable frequency drive. Slurry pump 70 may also contain a hopper paddle feeder and a rotor-stator assembly, and a vibratory air motor. A slurry containment hopper, which may have a volume of 0.17 cubic meters, may be disposed to receive slurry from the product vessel 60. When this configuration is activated, and slurry is present, the pump rotates at varying speeds to feed slurry from the containment hopper by use of the paddle feeder forcing slurry into the rotor stator assembly where slurry is evenly extruded though the pump discharge outlet. The vibratory air motor levels the slurry in the slurry hopper so that vessel measuring sensor 66 obtains accurate measurements of the slurry quantity 68 in product vessel 60.

In a typical configuration, spray nozzle 80 contains a 30 cm×2.5 cm diameter hydraulic hose section connected to a cast aluminum nozzle head with an integrated atomizing air and tube and a 12 mm atomizing rubber nozzle cap. When slurry is pumped to the nozzle, low compressed air is injected into the slurry stream just prior to the point of exit (a 12 mm hole concentric with atomizing air tube) This activity creates a conical pattern of slurry that is then applied to the surface.

Air supply valve actuator 90 for air supply valve 88 may be a two-way fluid solenoid.

Machine control may be achieved by using an Allen Bradley Micrologixs 1400 PLC controller as controller 100 and a C-More Human Machine Interface display as human/machine interface display 102. A human/machine interface display is a screen that allows a user to interact with a device, such as a device conducting or controlling an industrial process.

Formulations that can be used with the disclosed apparatus include alumina formulations containing calcium aluminate cements and dispersing agents.

Although the batch production and continuous application device enables the production of refractory slurry with a range of densities from a single mixture of components, it also enables the production of sequential batches of refractory slurry that differ in water content.

The batch production and continuous application device 2 may be configured to prevent production of excess slurry. If the product vessel 60 is unable to keep pace with the batch reactor 10, the product vessel measuring sensor 66 identifies excessive slurry in the product vessel 60 (e.g., by providing information to the data processor/storage unit 112 for a determination that the product vessel 60 cannot accommodate the contents of the batch reactor 10), and the data processor/storage unit 112 places the batch reactor 10 in a "hold" state until enough slurry has been displaced from the product vessel 60 such that an additional batch can be discharged from the batch reactor 10 and entirely contained in the product vessel 60. The "hold" state may include halting the mixing process and/or halting the transfer of slurry from the batch reactor 10 to the product vessel 60. This may be accomplished in a configuration of device 2 in which the data processor/storage unit 112 is configured to process data received from the product vessel content sensor 66 to control the batch reactor drive regulator 18 and the batch reactor door actuator 24.

The batch production and continuous application device 2 may also be configured so that, if the product vessel 60 is unable to keep pace with the batch reactor 10, the product vessel measuring sensor 66 identifies excessive slurry in the product vessel 60 (e.g., by providing information to the data processor/storage unit 112 for a determination that the product vessel 60 cannot accommodate the contents of the batch reactor 10), and the data processor/storage unit 112 deactivates the transfer of powder, water, and other formulation components to the batch reactor 10 until enough slurry has been displaced from the product vessel 60 such that an additional batch can be discharged from the batch reactor 10 and entirely contained in the product vessel 60. This may be accomplished in a configuration of device 2 in which the data processor/storage unit 112 is configured to process data received from the product vessel content sensor 66 to control the powder feed valve regulator 40, the water valve actuator 56, and the batch reactor drive regulator 18. Data processor/storage unit may also process data received from the product vessel content sensor 66 to control the batch reactor door actuator 24.

The batch production and continuous application device 2 may also be configured to prevent interruption of the application process due to a lack of slurry in the product vessel 60. In one configuration, if the product vessel measuring sensor 66 detects a predetermined minimum quantity or low level of slurry in the product vessel 60, a signal is sent to the controller human/machine interface display 102. The operator then reduces the maximum speed (rpm) of slurry pump 70. In another configuration, if the product vessel measuring sensor 66 detects a low level of slurry in the product vessel 60, the data processor/data storage unit 112 performs a calculation based on the cumulative rate of slurry use (S/T), based on data obtained from the quantity of slurry 68 (S) in product vessel 60, and remaining mixing time (RMT) of the batch in the batch reactor 10. If (S/T)>(S/(RMT)), the slurry pump regulator 72 reduces maximum rate of slurry use so that it is less than (S/(RMT)).

In terms of structure, the outlet of the powder bin 30 is in communication with the inlet of the powder feed valve 38. The outlet of the powder feed valve 38 is in communication with the inlet of the powder feeder 42. The outlet of the powder feeder 42 is in communication with the batch reactor powder feed port 12 of the batch reactor 10. Water supply 50 extends from a source of water, through the water valve 54 to the batch reactor water feed inlet 14. The outlet of the batch reactor 10 is in communication with the inlet of the product vessel 60. The outlet of the product vessel 60 is in communication with the input of the slurry pump 70. The outlet of the slurry pump 70 is in communication with an inlet, or the inlet, of the nozzle 80. An air supply line extends from a source of pressurized air, through the air supply valve 88 and the air hose 86, to an inlet, or the inlet, of the nozzle 80. Air from the air hose 86 and the product or contents of the slurry hose 76 are combined in the nozzle 80 and are sprayed from the nozzle 80.

The method of producing, and continuously applying, a refractory composition to a surface with the batch production and continuous application device 2 is carried out as follows: Dry components of the formulation are introduced into the powder bin 30. A powder bin vibratory device 32 may be activated by the powder bin vibratory device actuator, which may be controlled by the data processor/data storage unit of 112 of controller 100 via command transmission port 106. An operator enters batch production settings and instructions, such as the batch size, water content, dry component content, mixing time, and mixing speed, as well as the command to start batch production, into the controller 100 by way of the controller human/machine interface display 102, the control panel 104 or other input device. Controller 100 transmits a command through the command transmission port 106 to the powder feed valve regulator 40 and the powder feed valve 38, and/or to the powder feeder regulator 42, to transfer dry components from the powder bin 30 to an inlet of the powder feeder 42. Dry components are transferred from an outlet of the powder feeder 42 to the batch reactor powder feed port 12 and into batch reactor 10. The amount of powder transferred from the powder bin 30 into the batch reactor 10 may be determined by difference, before and after transfer, by the load measurement sensor 20. Data from the load measurement sensor 20 may therefore be used to control the transfer of powder from the powder bin 30 to the batch reactor 10.

Controller 100 transmits a command through the command transmission port 106 to the water valve actuator 56, and the water valve 54, to introduce water from the water supply 50 into the batch reactor 10. The amount of water transferred into the batch reactor 10 may be obtained by the water flow sensor 52 or determined by difference, before and after transfer, by the load measurement sensor 20. Data from the load measurement sensor 20 may therefore be used to control the supply of water to the batch reactor 10. Additional liquid or dissolved components may be introduced into the water supply 50 or may be introduced into the batch reactor 10 from a separate vessel equipped with a valve and a valve actuator. Controller 100 derives the amount of material (or the mass or density) in the batch reactor 109 from data supplied by the sensor 52, and/or sensor 20.

The process of placing batch components into the batch reactor 10 is referred to as "charging." When all batch components have entered the batch reactor 10 in the selected quantities, the controller 100 transmits a command through the command transmission port to the batch reactor drive regulator 18 to activate the batch reactor drive 16 to start the mixing the process within the batch reactor 10. Controller 100 regulates the start, finish, pausing, length of time, and the intensity, of the mixing. Controller 100 also calculates and maintains the value of mixing time remaining. The intensity of mixing is related to the speed of rotation of the mixing configuration, and the configuration of the mixing assembly 17 such as mixing blades or paddles, within the batch reactor 10. Batch reactor 10 may contain an agitator of any known type. Batch size, length of time of mixing, and intensity of mixing of a combination of components can be selected on the basis of a calibration table relating combinations of batch size, mixing time and mixing intensity of a particular combination of components to produce a slurry with a specified density.

During batch mixing, the controller 100 monitors the content 68 of the product vessel 60. Product vessel content sensor 66 provides this information to the controller 100 through the data acquisition port 108 so that the amount of product in the product vessel 60 may be determined by the data processor/data storage unit 112. If the product vessel 60 is unable to accommodate a batch being mixed, controller 100 transmits a command to the batch reactor drive actuator 18 to pause batch mixing until the product vessel 60 can accommodate the batch. If a batch is not being mixed and the product vessel 60 cannot accommodate the next batch to be mixed, the combining of components and initiation of batch mixing are delayed until the product vessel 60 can accommodate the batch. Typically, the process vessel 60 accommodates at least two batches produced by the batch reactor 10, so the batch mixing process will not need to be halted during the production of the initial batch.

When batch mixing is completed, and the contents of the batch mixer 10 can be accommodated by the product vessel 60, the controller 100 transmits a command to the batch reactor door actuator 24 to open the batch reactor door 22. The contents of the batch mixer 10 are thereby transferred to the product vessel 60. Product vessel 60 may be equipped with a product vessel vibratory device 62 in communication with a product vessel vibratory actuator 64. The product vessel vibratory device 62 may be electrically or pneumatically powdered. The product vessel vibratory device 62 ensures that slurry remains in contact with, and will exit through, an exit port of the product vessel 60. The presence of product in the product vessel 60, which may be sensed by a product vessel content sensor 66, may be received by the controller 100 and used by the data processor/storage unit 112 to communicate to the product vessel vibratory device actuator 64 a command to commence operation of the product vessel vibratory device 62.

The portion of the process occurring before the start of spraying may be referred to as system initialization. When product is present in the product vessel 60, spraying of the slurry may begin. Controller 101 transmits commands to the slurry pump regulator 72 to control the rate of pumping of the slurry pump 70 to provide product or slurry to the nozzle 80, and to the air supply valve actuator 90 to control the rate of air flow through the air supply valve 88 and the air hose 86 to provide air to the nozzle 80. Slurry flows from the slurry pump 70 through the slurry hose 76 to the nozzle 80; air flows through the air hose 86 to the nozzle 80. Air flow sensor 92 transmits flow rate information to the Controller 100; Controller 100 transmits commands to the slurry pump regulator 72 the air supply valve actuator 90 to balance the flow rates through the slurry pump 70 and the air hose 86 so that the slurry is sprayed from the nozzle 80 at the intended pressure. The operator may adjust the pumping rate of the slurry pump 70 at any time during the process by entering a command through the controller human/machine interface display 102 or through the control panel 104, or by manipulating the air supply valve actuator 90; in certain configurations of the apparatus, the pumping rate of the slurry pump 70 is maintained at a set ratio to the rate of air flow through the air supply valve 88. Data processor/data storage unit 112 may be configured to generate a ratio of the flow rate through the slurry pump 70 to the flow rate through the air hose 86, and to maintain the ratio of the slurry pump flow rate and the air hose flow rate when the air hose flow rate is altered. The operator may halt operation of the slurry pump 70 by entering a "stop" command through the controller human/machine interface display 102 or through the control panel 104, or by manipulating the air supply valve actuator 90; in certain configurations of the apparatus, the slurry pump 70 is shut off when air flow through the air supply valve 88 is shut off. In certain configurations of the batch production and continuous application device 2, the deactivation of the slurry pump 70 and/or the air supply after system initialization blocks the initiation of a batch process in the batch mixer 10. Data provided by the product vessel content sensor 66 may be received by the controller 100 and used by the data processor/storage unit 112 to block the initiation of batch processing in the batch mixer 10, or the introduction of formulation components into the batch mixer 10, if a new batch cannot be accommodated by the product vessel 60.

A process making use of the device described herein for batch production of, and continuous application of, a refractory composition to a surface may include the following steps:

(a) providing a batch production and continuous application device 2 according to claim 1;

(b) providing instructions to the controller 100.

(c) utilizing the data processor/storage unit 112, the powder feed valve regulator 40 and the powder feed valve 38, and data from the product vessel content sensor 66 to control the transfer of powder from the powder bin 30 to the batch reactor 10 to charge the batch reactor 10;

(d) utilizing the data processor/storage unit 112, the batch reactor drive regulator 18, the batch reactor drive 16, and data from the product vessel content sensor 66 to activate, control, and deactivate the mixing assembly 17 in the batch reactor 10 to process the powder to form a product;

(e) utilizing the data processor/storage unit 112, the batch reactor door actuator 24, and the batch reactor door 22, and data from product the vessel content sensor 66 to feed the product from the batch reactor 10 into the product vessel 60;

(f) transferring the product from the product vessel 60 to a nozzle 80;

(g) providing air to the nozzle 80;

(h) combining the product with air within the nozzle 80;

(h) spraying the combined air and product; and (i) repeating steps (c), (d), and (e) to produce a continuous supply of product.

Step (c) may further include (c') utilizing the data processor/storage unit 112, the water valve actuator 56, the water valve 54, and data from product the vessel content sensor 66 to control the input of water to the batch reactor 10.

Step (c) may include the limitation that the transfer of powder from the powder bin 30 to the batch reactor 10 and the input of water to the batch reactor 10 is enabled if the data processor/storage unit 112 determines that the batch reactor 10 is not charged, and that the product vessel 60 can accommodate the product to be produced from the powder and water to be input into the batch reactor 10, and that at least one of system initialization (in which a product is produced at the beginning of operation before spraying can commence) and spraying is occurring.

Step (d) may include:

activating the mixing assembly 17 if the data processor/storage unit 122 determines that the slurry pump 70 is activated, that the batch reactor 10 is charged, and that the product vessel 60 can accommodate the contents of the batch reactor 10;

activating the mixing assembly 17 during system initialization if the batch reactor 10 is charged, and the product vessel 60 can accommodate the contents of the batch reactor 10;

pausing the mixing assembly 17 if the data processor/storage unit 122 determines that the slurry pump 70 is activated, that the batch reactor 10 is charged, and that the product vessel 60 cannot accommodate the contents of the batch reactor 10;

deactivating the mixing assembly 17 if the data processor/storage unit 122 determines that the batch processing is completed; and deactivating the mixing assembly 17 if the data processing/storage unit 122 determines that the slurry pump 70 is deactivated.

Data from the load measurement sensor 20 may be used to control the transfer of powder from the powder bin 30 to the batch reactor 10 to charge the batch reactor 10, and to control the supply of water to the batch reactor 10.

EXAMPLE

Batch production and continuous application the device 2 is capable of producing, from a single mixture of components, refractory slurries having a range of densities. The variety of densities is produced by mixing the components with particular values in ranges of mixing times and speeds. A calibration table showing slurry densities produced for various combinations of mixing times, mixing speeds, and spraying pressures enables the device to be programmed, and instructions to be entered, to produce a formulation with a desired density.

Example 1

The table below shows the results of experiments conducted to correlate batch reactor mixer speed and stirring time to densities as a function of density reduction. The baseline density of this formulation using a conventional continuous mixer is approximately 120 lb/ft$^3$ (1 920 kg/m$^3$). The mixture of dry components contained 93% refractory, 0.25% anionic surfactant, and binding materials. The mixture of dry components was mixed with water to produce a slurry containing 20 wt % water. 200 lb (90 kg) batches of mixed dry components were batch mixed for 7 minutes. Water was then added, and the batches were mixed for the time periods, and at the speeds, shown in TABLE 1. Densities were obtained for slurries as removed from the batch mixer or after spraying, as indicated in the table.

TABLE I

Relationship of mixing speed, mix time, and spraying pressure to density

| Mixing speed (RPM) | Mix time (min) | Density | Sample |
|---|---|---|---|
| 42 | 3 | 1540 kg/m$^3$<br>96.0 lb/ft$^3$ | Out of mixer |
| 42 | 5 | 1450 kg/m$^3$<br>90.7 lb/ft$^3$ | Out of mixer |
| 42 | 8 | 1370 kg/m$^3$<br>85.4 lb/ft$^3$ | Out of mixer |
| 42 | 8 | 1530 kg/m$^3$<br>95.7 lb/ft$^3$ | Sprayed 20 lb/in$^2$<br>(140 kPa) |
| 42 | 8 | 1690 kg/m$^3$<br>105.5 lb/ft$^3$ | Sprayed 30 lb/in$^2$<br>(210 kPa) |
| 42 | 8 | 1740 kg/m$^3$<br>108.8 lb/ft$^3$ | Sprayed 35 lb/in$^2$<br>(240 kPa) |
| 42 | 8 | 1610 kg/m$^3$<br>100.4 lb/ft$^3$ | Sprayed 15 lb/in$^2$<br>(103 kPa) |
| 84 | 5 | 1310 kg/m$^3$<br>81.6 lb/ft$^3$ | Out of mixer |
| 84 | 5 | 1790 kg/m$^3$<br>111.6 lb/ft$^3$ | Sprayed 20 lb/in$^2$<br>(140 kPa) |
| 84 | 5 | 1590 kg/m$^3$<br>99.5 lb/ft$^3$ | Sprayed 10 lb/in$^2$<br>(69 kPa) |
| 84 | 2.5 | 1560 kg/m$^3$<br>97.44 lb/ft$^3$ | Out of mixer |
| 84 | 2.5 | 1700 kg/m$^3$<br>106.44 lb/ft$^3$ | Sprayed 20 lb/in$^2$<br>(140 kPa) |
| 84 | 2.5 | 1570 kg/m$^3$<br>97.8 lb/ft$^3$ | Sprayed 10 lb/in$^2$<br>(69 kPa) |

ELEMENTS

2. Batch production and continuous application device
10. Batch reactor
12. Batch reactor powder feed port
14. Batch reactor water feed inlet
16. Batch reactor drive
17. Mixing assembly
18. Batch reactor drive regulator
20. Load measurement sensor
22. Batch reactor door
24. Batch reactor door actuator
30. Powder bin
32. Powder bin vibratory device
34. Powder bin vibratory device actuator
38. Powder feed valve

40. Powder feed valve regulator
42. Powder feeder
44. Powder feeder regulator
50. Water supply
52. Water flow sensor
54. Water valve
56. Water valve actuator
60. Product vessel
62. Product vessel vibratory device
64. Product vessel vibratory device actuator
66. Product vessel content sensor
68. Product vessel content
70. Slurry pump
72. Slurry pump regulator
76. Slurry hose
80. Nozzle
86. Air hose
88. Air supply valve
90. Air supply valve actuator
92. Air flow sensor
100. Controller
101. Controller connections
102. Controller human/machine interface display
104. Control panel
106. Command transmission port
108. Data acquisition port
112. Data processor/data storage unit The invention can comprise, consist of, or consist essentially of the various features and characteristics described in this specification. In some cases, the invention can also be essentially free of a component or other feature or characteristic described in this specification.

Also, any numerical range recited in this specification includes the recited endpoints and describes all sub-ranges of the same numerical precision (i.e., having the same number of specified digits) subsumed within the recited range. For example, a recited range of "1 0.0 to 10.0" describes all sub-ranges between (and including) the recited minimum value of 1 0.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will comply with written description, sufficiency of description, and added matter requirements (e.g., 35 U.S.C. S 1 12(a) and Article 123(2) EPC).

The grammatical articles "one", "a", "an", and "the", as used in this specification, are intended to include "at least one" or "one or more", unless otherwise indicated or required by context. Thus, the articles are used in this specification to refer to one or more than one (i.e., to "at least one") of the grammatical objects of the article.

By way of example, "a component" means one or more components, and thus, possibly, more than one component is contemplated and can be employed or used in an implementation of the invention. Further, the use of a singular noun includes the plural, and the use of a plural noun includes the singular, unless the context of the usage requires otherwise.

The invention claimed is:

1. A batch production and continuous application device, comprising:

a powder bin having an outlet;

a powder feed valve located at the outlet of the powder bin;

a powder feed valve regulator in controlling communication with the powder feed valve;

a batch reactor comprising an inlet, a door, a batch reactor drive, a mixing assembly, a batch reactor drive regulator, and a batch reactor door actuator;

wherein the outlet of powder bin is in communication with inlet of the batch reactor;

wherein the batch reactor drive regulator is in controlling communication with a batch reactor drive;

wherein the batch reactor drive is in mechanical communication with the mixing assembly; and wherein the batch reactor door actuator is in controlling communication with the door;

a product vessel having an inlet and an outlet, wherein the inlet of the product vessel is configured to receive contents of the batch reactor passing through the door;

a product vessel content sensor in sensing communication with an amount of content of the product vessel;

a controller comprising a data processor/storage unit;

wherein the data processor/storage unit is in receiving communication with the product vessel content sensor, wherein the data processor/storage unit is in controlling communication with the powder feed valve regulator;

wherein the data processor/storage unit is in controlling communication with the batch reactor drive regulator; and wherein the data processor/storage unit is in controlling communication with the batch reactor door actuator;

a nozzle having an inlet and an outlet, wherein the inlet of the nozzle receives an output of the outlet of the product vessel;

wherein the inlet of the nozzle receives an output of an air hose;

and wherein flow of air in the air hose is regulated by an air supply valve and controlled by an air supply valve actuator, a water valve;

a water supply, wherein the water supply extends through the water valve to a batch reactor water feed inlet of the batch reactor; and a water valve actuator;

wherein the water valve actuator is in controlling communication with the water valve, and wherein the data processor/storage unit is in controlling communication with the water valve actuator.

2. The batch production and continuous application device according to claim 1, further comprising:

a powder feeder comprising an inlet and an outlet, wherein the outlet of the powder bin is in communication with the inlet of the powder feeder, wherein the outlet of the powder feeder is in communication with the inlet of the batch reactor; and a powder feeder regulator, wherein the powder feeder regulator is in controlling communication with the powder feeder; and wherein the data processor/storage unit is in controlling communication with the powder feeder regulator.

3. The batch production and continuous application device according to claim 1, further comprising:

a slurry pump comprising an inlet and an outlet, wherein the inlet of the slurry pump is in communication with the outlet of the product vessel; wherein the outlet of the slurry pump is in communication with the inlet of the nozzle; and a slurry pump regulator; wherein the slurry pump regulator is in controlling communication with the slurry pump; and wherein the data processor/storage unit is in controlling communication with the slurry pump regulator.

4. The batch production and continuous application device according to claim 3, wherein: the data processor/storage unit is configured to generate a ratio of a flow rate through the slurry pump to a flow rate through the air hose, and to maintain the ratio of the flow rate through the slurry pump and the flow rate through the air hose when the flow rate through the air hose is altered.

5. The batch production and continuous application device according to claim 4, further comprising:

a water flow sensor in sensing communication with the water supply, wherein the data processor/storage unit is in receiving communication with the water flow sensor.

6. The batch production and continuous application device according to claim 4, wherein the data processor/storage unit is configured to process data received from the product vessel content sensor to control the powder feed valve regulator, the water valve actuator, and the batch reactor drive regulator.

7. The batch production and continuous application device according to claim 1, further comprising:

a load measurement sensor in sensing communication with the batch reactor, wherein the data processor/storage unit is in receiving communication with the load measurement sensor.

8. The batch production and continuous application device according to claim 1, further comprising:

a powder bin vibratory device in communication with the powder bin, a powder bin vibratory device actuator;

wherein the powder bin vibratory device actuator is in controlling communication with the powder bin vibratory device;

a product vessel vibratory device in communication with the product vessel, and a product vessel vibratory actuator, wherein the product vessel vibratory actuator is in controlling communication with the product vessel vibratory device.

9. The batch production and continuous application device according to claim 1, wherein: the batch reactor drive is configured to supply at least 7500 watts of mechanical power to the mixing assembly.

10. A process for batch production and continuous application of a refractory formulation, the process comprising:

(a) providing a batch production and continuous application device according to claim 1;

(b) providing instructions to the controller;

(c) utilizing the data processor/storage unit, the powder feed valve regulator and the powder feed valve, and data from the product vessel content sensor to control a transfer of a powder from the powder bin to the batch reactor to charge the batch reactor;

(d) utilizing the data processor/storage unit, the batch reactor drive regulator, the batch reactor drive, and data from the product vessel content sensor to activate, control, and deactivate the mixing assembly in the batch reactor to process the powder to form a product;

(e) utilizing the data processor/storage unit, the batch reactor door actuator, and the batch reactor door, and data from the product vessel content sensor to feed the product from the batch reactor into the product vessel;

(f) transferring the product from the product vessel to the nozzle;

(g) providing air to the nozzle;

(h) combining the product with air within the nozzle;

(i) spraying the combined air and product; and (j) repeating steps (c), (d), and (e) to produce a continuous supply of product; and wherein step (c) further comprises:

(c') utilizing the data processor/storage unit, the water valve actuator, the water valve, and data from the product vessel content sensor to control an input of water to the batch reactor.

11. The process for batch production and continuous application of a refractory formulation according to claim 10, wherein the transfer of powder from the powder bin to the batch reactor and the input of water to the batch reactor is enabled if the data processor/storage unit determines that the batch reactor is not charged, and that the product vessel can accommodate the product to be produced from the powder and water to be input into the batch reactor, and that at least one of a system initialization and a spraying is occurring.

12. The process for batch production and continuous application of a refractory formulation according to claim 10, wherein the batch production and continuous application device further comprises a slurry pump comprising an inlet and an outlet; wherein the device further comprises a slurry pump regulator; wherein the inlet of the slurry pump is in communication with the outlet of the product vessel; wherein the outlet of the slurry pump is in communication with the inlet of the nozzle; and wherein the slurry pump regulator is in controlling communication with the slurry pump;

wherein the data processor/storage unit is in controlling communication with the slurry pump regulator; and wherein step (d) comprises:

activating the mixing assembly if the data processor/storage unit determines that the slurry pump is activated, that the batch reactor is charged, and that the product vessel can accommodate the contents of the batch reactor;

activating the mixing assembly during a system initialization if the batch reactor is charged, and the product vessel can accommodate the contents of the batch reactor;

pausing the mixing assembly if the data processor/storage unit determines that the slurry pump is activated, that the batch reactor is charged, and that the product vessel cannot accommodate the contents of the batch reactor;

deactivating the mixing assembly if the data processor/storage unit determines that the batch processing is completed;

deactivating the mixing assembly if the data processing/storage unit determines that the slurry pump is deactivated.

13. The process for batch production and continuous application of a refractory formulation according to claim 10, wherein the batch production and continuous application device further comprises a load measurement sensor in sensing communication with the batch reactor, wherein the data processor/storage unit is in receiving communication with the load measurement sensor; and wherein data from the load measurement sensor is used to control the transfer of powder from the powder bin to the batch reactor to charge the batch reactor, and to control the supply of water to the batch reactor.

* * * * *